US005423583A

United States Patent [19]

Crockom

[11] Patent Number: 5,423,583

[45] Date of Patent: Jun. 13, 1995

[54] DOOR KNOB SPINNER LOCK

[76] Inventor: James Crockom, 12919 Windfern Rd., #1703, Houston, Tex. 77064

[21] Appl. No.: 236,186

[22] Filed: May 2, 1994

[51] Int. Cl.[6] ..... E05B 17/14

[52] U.S. Cl. ..... 292/289; 292/1; 292/DIG. 2; 70/416; 70/424

[58] Field of Search ..... 292/289, 347, 1, DIG. 2, 292/336.3; 70/211, 428, 209, 210, 232, 423, 424, 416; 403/344

[56] References Cited

U.S. PATENT DOCUMENTS 4,561,273 12/1985 Robinson ..... 70/209
4,570,470 2/1986 Gray, Sr. ..... 70/428
4,631,938 12/1986 Johnson ..... 70/209
4,798,069 1/1989 De Forrest, Sr. ..... 70/209
4,899,564 2/1990 Gilbert ..... 292/DIG. 2

*Primary Examiner*—Peter M. Cuomo
*Assistant Examiner*—Monica E. Millner

[57] ABSTRACT

An openable rotatable shell which is positioned on and encloses a conventional key lock door knob. The shell freely rotates and prevents exerting a turning force on the knob. Since the keyhole on the knob is covered by such shell, the door cannot be opened until a second lock provided on the shell is opened allowing the shell to be removed from the knob.

3 Claims, 4 Drawing Sheets

DOOR KNOB SPINNER LOCK

BACKGROUND OF THE INVENTION

1. Field of the Invention

The present invention relates to door knobs and more particularly pertains to rotatable door knob cover which may be locked in place over the door knob.

2. Description of the Prior Art

The use of door knob covers is known in the prior art. More specifically, covers heretofore devised and utilized for the purpose of child-proofing a door knob, decorative purposes, etc. are known to consist basically of familiar, expected and obvious structural configurations, notwithstanding the myriad of designs encompassed by the crowded prior art which have been developed for the fulfillment of countless objectives and requirements. Typical of such covers and related door knobs are illustrated in U.S. Pat. Nos. 5,008,551; 4,082,351; 3,896,645; 4,578,970; and 5,074,607.

In this respect, the door knob cover according to the present invention substantially departs from the conventional concepts and designs of the prior art, and in so doing provides an apparatus primarily developed for the purpose of providing additional security for a keyhole-type door knob.

Therefore, it can be appreciated that there exists a continuing need for new and improved means for protecting door knobs. In this regard, the present invention substantially fulfills this need.

SUMMARY OF THE INVENTION

In view of the foregoing disadvantages inherent in the known types of door knobs now present in the prior art, the present invention provides an improved construction wherein the same can be utilized to provide auxiliary locking protection for a door knob. As such, the general purpose of the present invention, which will be described subsequently in greater detail, is to provide a new and improved door knob apparatus which has all the advantages of the prior art devices and none of the disadvantages.

To attain this, the present invention essentially comprises an openable rotatable shell which is positioned on and encloses a conventional key lock door knob. The shell freely rotates and prevents exerting a turning force on the knob. Since the keyhole on the knob is covered by such shell, the door cannot be opened until a second lock provided on the shell is opened allowing the shell to be removed from the knob.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved door knob cover which has all the advantages of the prior art devices and none of the disadvantages.

It is another object of the present invention to provide a new and improved door knob cover which may be easily and efficiently manufactured and marketed.

It is a further object of the present invention to provide a new and improved door knob cover which is of a durable and reliable construction.

An even further object of the present invention is to provide a new and improved door knob cover which is susceptible of a low cost of manufacture with regard to both materials and labor, and which accordingly is then susceptible of low prices of sale to the consuming public, thereby making such covers economically available to the buying public.

Still yet another object of the present invention is to provide a new and improved door knob cover which provides in the apparatuses and methods of the prior art some of the advantages thereof, while simultaneously overcoming some of the disadvantages normally associated therewith.

Still another object of the present invention is to provide a new and improved door knob cover which is locked into place.

Yet another object of the present invention is to provide a new and improved auxiliary locking system for a door knob.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
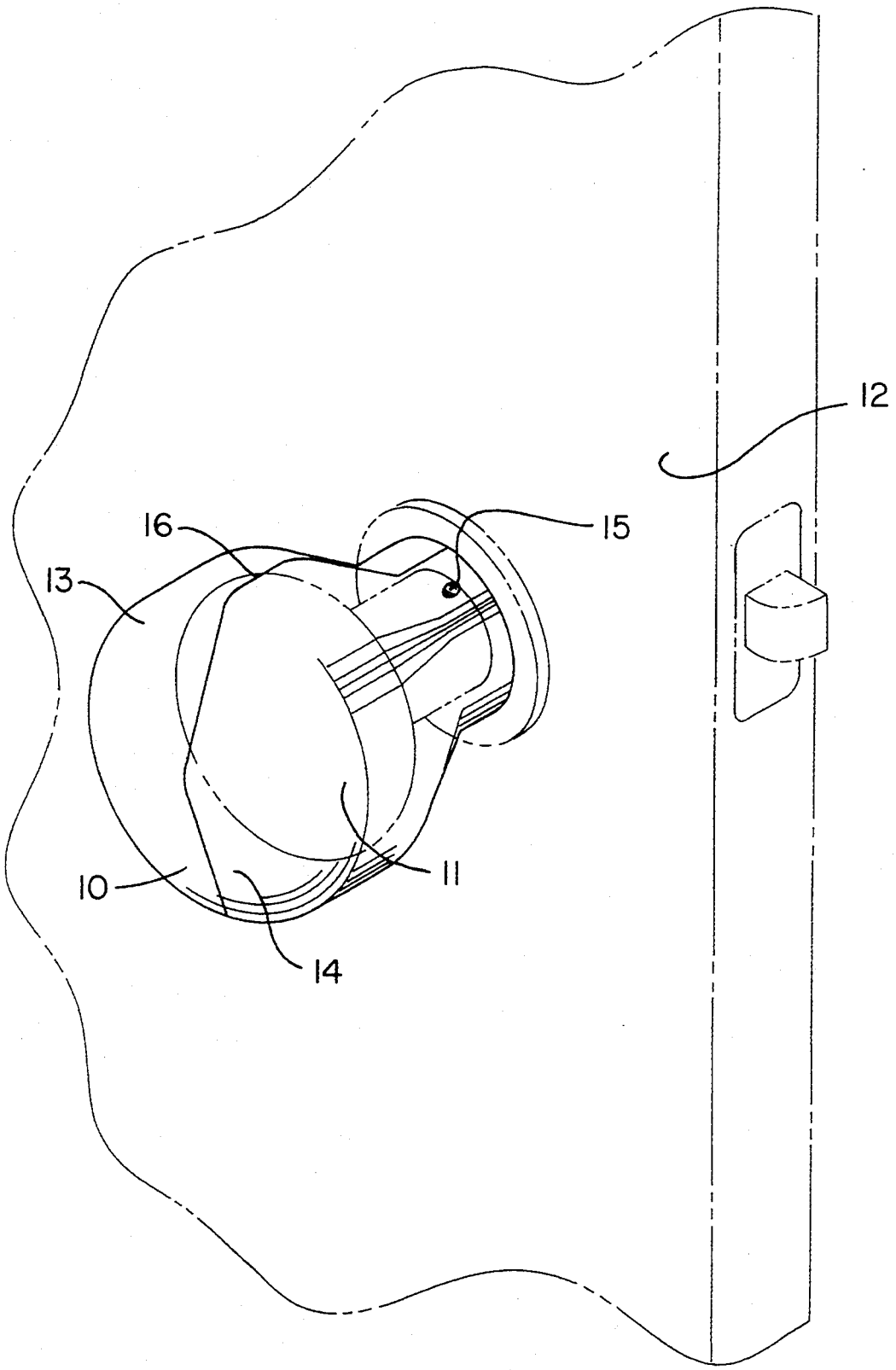
FIG. 1 is a perspective view of the present invention in place on a door.

With reference now to the drawings, and in particular to FIG. 1 thereof, a new and improved door knob cover embodying the principles and concepts of the present invention and generally designated by the reference numeral 10 will be described.

More specifically, it will be noted that the knob cover 10 of the present invention is a hollow shell which completely encloses the regular knob 11 for door 12 (shown in broken lines) cover 10 has two-halves indicated as respective first and second halves 13 and 14 hinged as shown in subsequent drawings, so that cover 10 may be removed from knob 11. To prevent unauthorized removal, the halves 13 and 14 are locked to each other along juncture line 16 with a key lock 15 (shown in detail in FIG. 7). Cover 10 is made of heavy gage metal such as steel to form a rigid enclosure. Since cover 10 is not deformable, when in place it prevents any squeezing pressure from causing the cover 10 to frictionally engage the knob 11, thus eliminating any torque being applied to such knob 11 which could cause fracture of the locking mechanism therein. Turning the knob cover 10 hence has no capability of opening door 12 since it merely rotates freely around the main knob 11. Likewise, cover 10 completely shields a keyhole, usually present in the conventional knob 11, from being jimmied or,if an unauthorized person has gained access to the key for knob 11, from such key being used to unlock knob 11.

Figure 2:
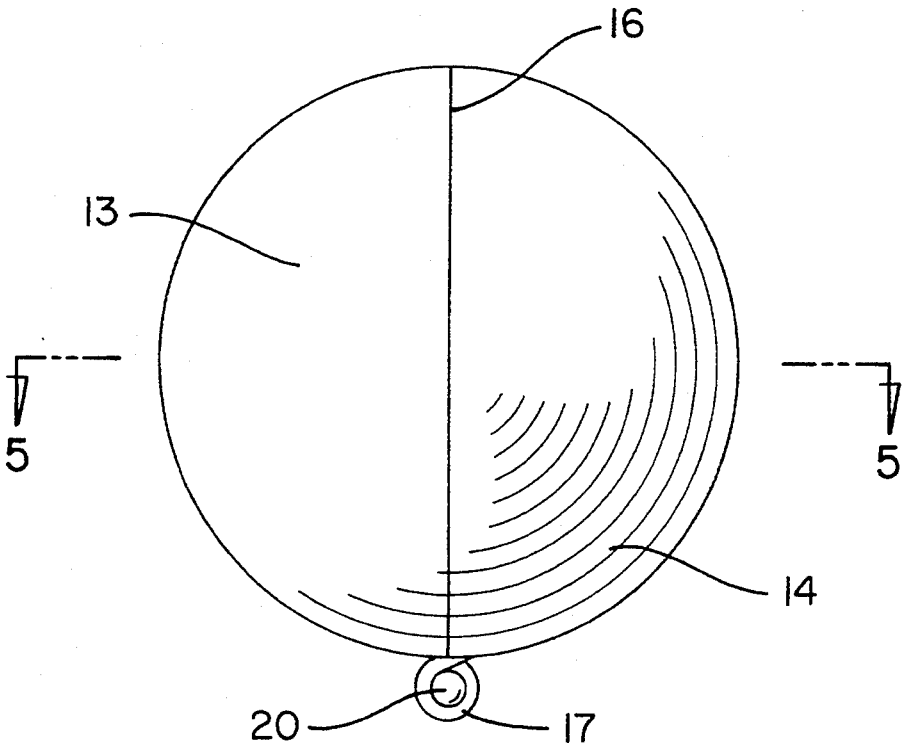
FIG. 2 is a front elevation of the door knob cover of the present invention.

FIG. 2 is a front elevation of the cover 10 shown in FIG. 1 illustrating the two halves 13 and 14 of such cover 10, the juncture line 16 and the hinge 17 pivotally connecting halves 13 and 14 together. While a variety of hinge types may be used, the drawings illustrate a simple construction of two flanges 18 on one half 14 with a mating flange 19 on the other half 13 and a headed pivot pin 20 extending through all three flanges and connecting them together.

Figure 3:
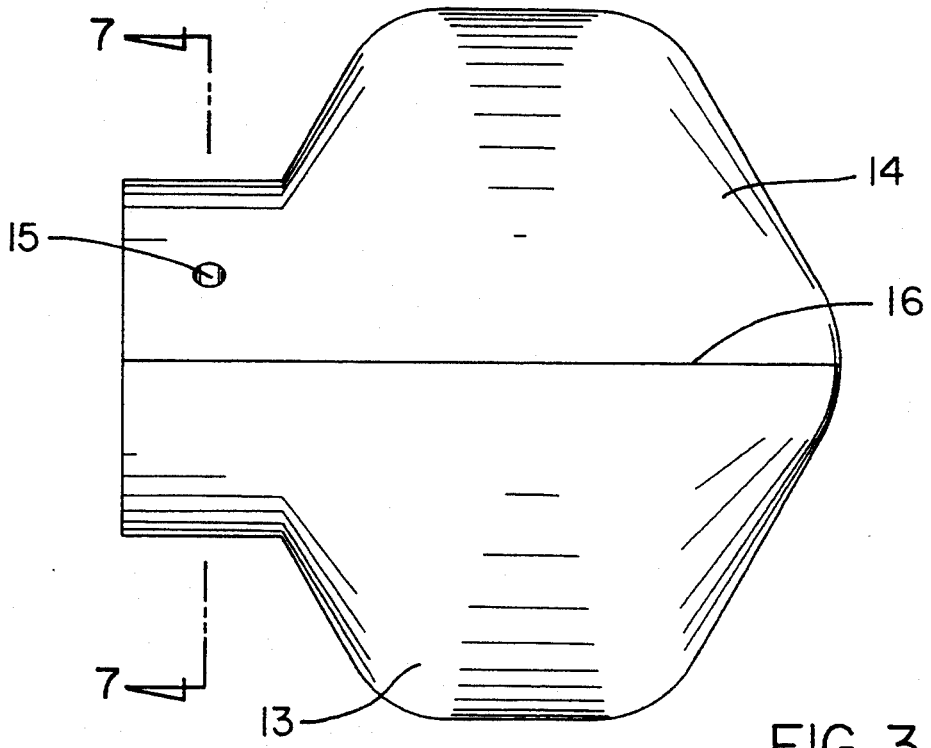
FIG. 3 is a side elevation of such door knob cover.

FIG. 3 is a side plan view of knob cover 10 again showing the elements 13, 14 and 16 with the addition of lock 15 on the shaft portion of elements 13 and 14.

Figure 4:
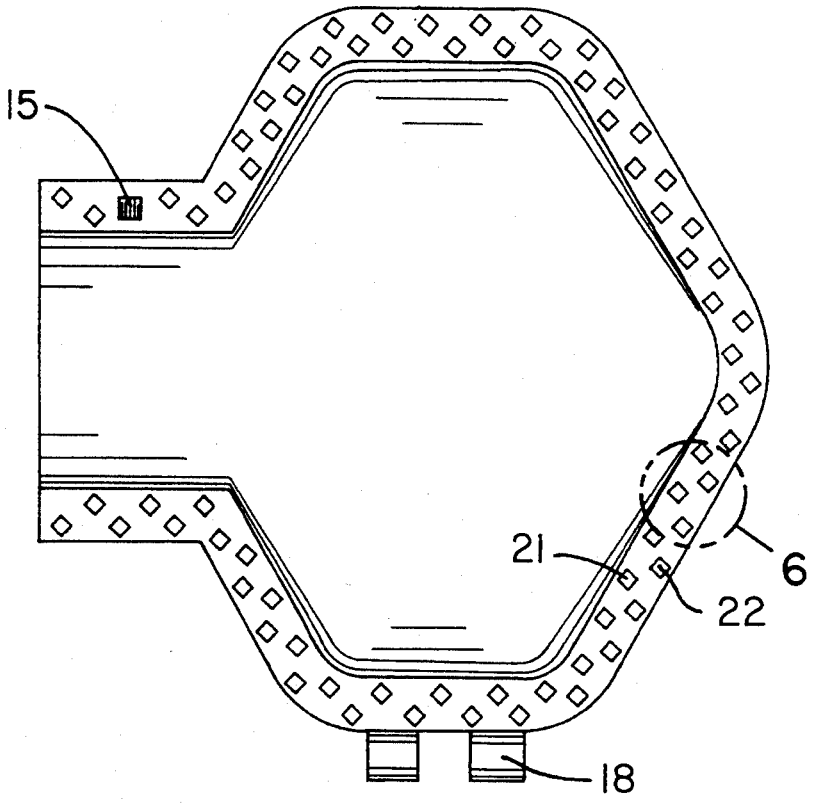
FIG. 4 is an internal side plan view of one half of the door knob cover of the present invention.

FIG. 4 illustrates that the walls of halves 13 and 14 adjacent juncture line 16 are protected against the insertion of a prying-type tool such as a screwdriver for the purpose of forcing the two halves 13 and 14 apart. This protection takes the form of a plurality of pointed projections 21 and mating recesses 22 (as shown in detail in FIG. 6). Such projections 21 and recesses 22 line the mating surfaces of halves 13 and 14 and are so arranged that the recesses 22 and projections 21 of one half will mate with corresponding projections 21 and recesses 22 of the other half along juncture line 16 when the halves 13 and 14 are brought together. This forms an impenetrable barrier to the insertion of a prying tool along the juncture line 16 between such halves 13 and 14.

Figure 5:
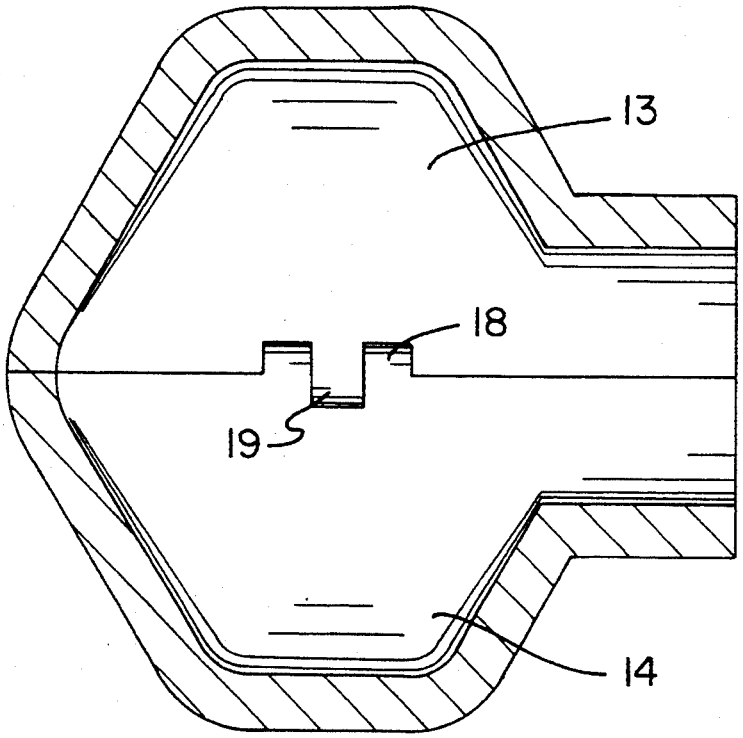
FIG. 5 is a sectional view on line 5—5 of FIG. 2.

FIG. 5 shows a sectional view on line 5-5 of FIG. 2 and illustrates the flanges 18 and 19.of the hinge 17 described in connection with FIG. 2 above.

Figure 6:
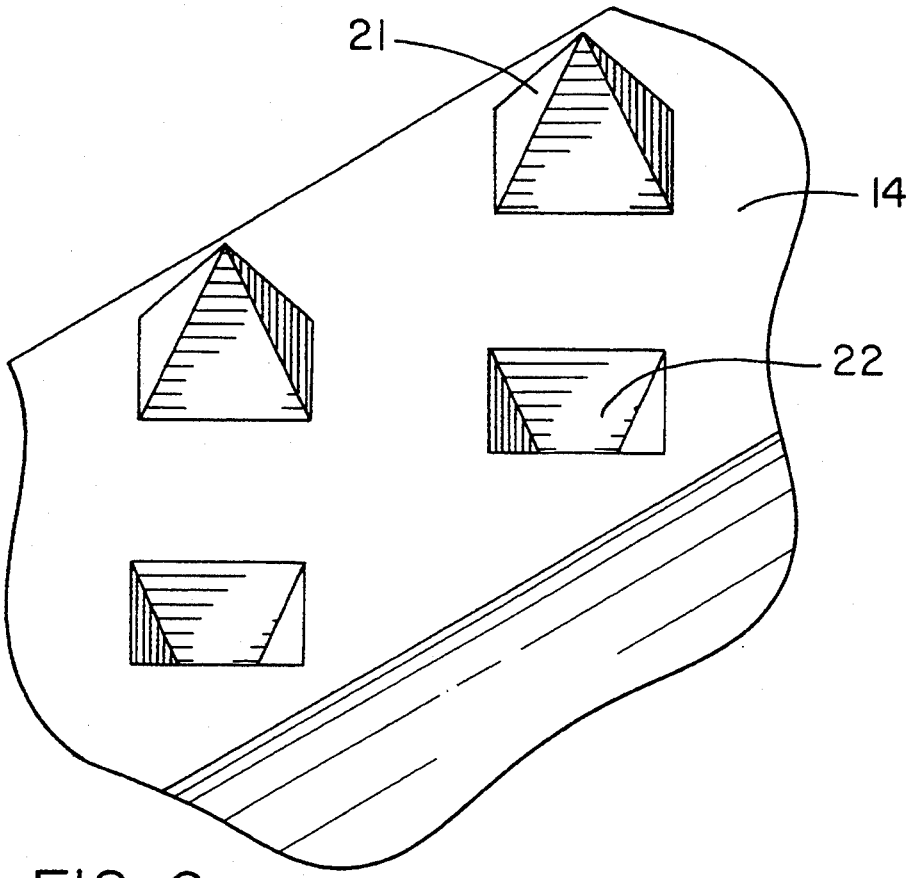
FIG. 6 is an enlarged perspective view of the section shown in a circle marked "6" on FIG. 4.

FIG. 6 shows in detail the projections 21 and recesses 22 in the mating surfaces of halves 13 and 14 as discussed in connection with FIG. 4 above.

Figure 7:
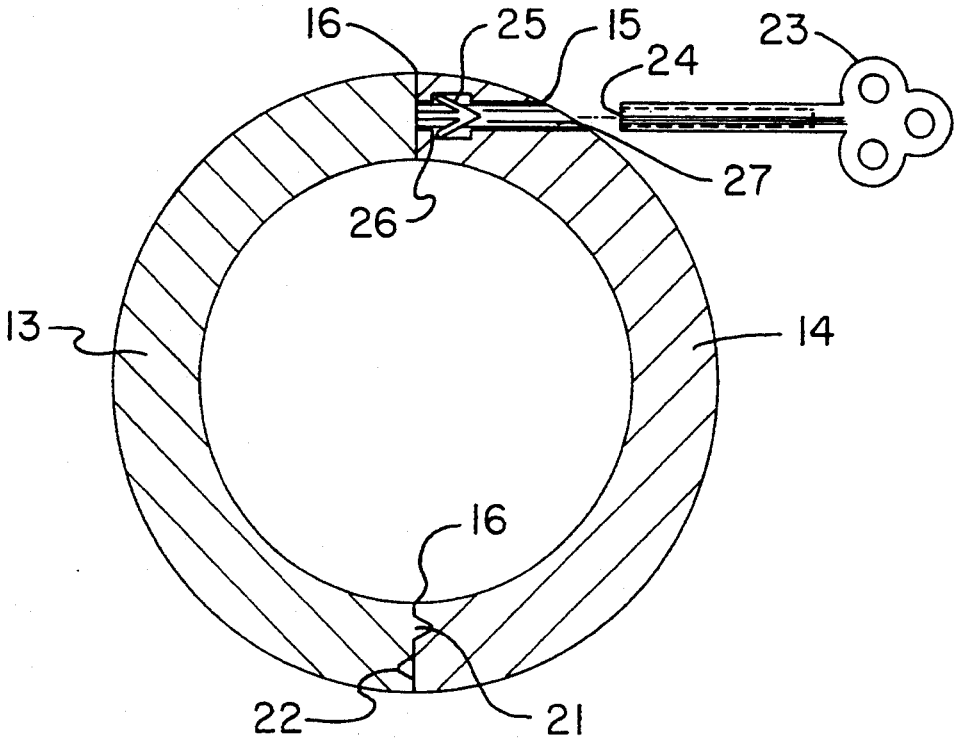
FIG. 7 is a sectional view on line 7—7 of FIG. 3.

FIG. 7 illustrates the lock 15 on cover 10 and also shows the interlocking projections 21 and recesses 22 along the juncture line 16 between halves 13 and 14. While a variety of types of key locks can be used, the version shown in this FIG. 7 is of the squeeze-type wherein the key 23 has a recess 24 therein adapted to slide into the key hole 27 and engage with a pair of spring arms 25. Continued insertion of key 23 causes arms 25 to compress towards each other within recess 24 and free such arms 25 from engagement with the retaining flanges 26. This frees the halves 13 and 14 from locking engagement with each other and permits pivoting the said halves to open cover 10 and to remove the same from its encompassing arrangement over the door knob 11.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door knob spinner lock device which comprises: a rigid, non-compressible, hollow shell adapted to fit loosely over a door knob; a pair of hingedly connected halves comprising a first half and a second half forming said hollow shell; and a locking means releasably connecting said halves together along a juncture line to form said shell; said first half having a first mating surface arranged for engaging a second mating surface of said second half at the juncture line; wherein the first mating surface and the second mating surface of said juncture line each are formed with a plurality of mating projections and recesses coextensive of each of said first and second mating surface.

2. A door knob spinner lock device which comprises: a rigid, non-compressible, hollow shell adapted to fit loosely over a door knob; a pair of hingedly connected halves comprising a first half and a second half forming said hollow shell; and a locking means releasably connecting said halves together along a juncture line to form said shell; said first half having a first mating surface arranged for engaging a second mating surface of said second half at the juncture line; said first mating surface having a plurality of projections and a plurality of recesses with said second mating surface having a further plurality of projections and a further plurality of recesses, wherein each of the recesses of said first mating surface surroundingly receive one of the further projections of said second mating surface and each of the further recesses of the second mating surface surroundingly receive one of the projections of the first mating surface.

3. A device as in claim 1 wherein said locking means comprises a key lock.

* * * * *